US010640254B2

(12) United States Patent
Oostwouder

(10) Patent No.: US 10,640,254 B2
(45) Date of Patent: May 5, 2020

(54) COLLAPSIBLE CASE

(71) Applicant: Colgate-Palmolive Company, New York, NY (US)

(72) Inventor: Theodoor Oostwouder, Paris (FR)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/060,557

(22) PCT Filed: Dec. 18, 2015

(86) PCT No.: PCT/US2015/066652
§ 371 (c)(1),
(2) Date: Jun. 8, 2018

(87) PCT Pub. No.: WO2017/105489
PCT Pub. Date: Jun. 22, 2017

(65) Prior Publication Data

US 2018/0362206 A1 Dec. 20, 2018

(51) Int. Cl.
*B65D 5/355* (2006.01)
*B65D 5/02* (2006.01)

(52) U.S. Cl.
CPC ..... *B65D 5/0005* (2013.01); *B65D 5/0218* (2013.01); *B65D 5/0227* (2013.01)

(58) Field of Classification Search
CPC ..... B65D 5/0005; B65D 5/0218; B65D 5/36; B65D 5/3607
USPC .... 229/101, 117.01, 117.02, 117.07, 117.08, 229/920, 930, 931; 493/185
See application file for complete search history.

(56) References Cited

U.S. PATENT DOCUMENTS 2,752,032 A * 6/1956 Fish ..... B65D 85/185 206/279
3,300,166 A * 1/1967 Wojciechowski ... B65D 5/4283 229/117.01
3,313,467 A * 4/1967 Anderskow ..... B65D 5/0005 229/101

(Continued)

FOREIGN PATENT DOCUMENTS

CN 203318831 U 12/2013
FR 2612885 9/1988

OTHER PUBLICATIONS

International Search Report and Written Opinion of the International Searching Authority in International Application No. PCT/US2015/066652, dated Aug. 17, 2016.

(Continued)

*Primary Examiner* — Christopher R Demeree

(57) ABSTRACT

A collapsible container (200) for a product (202) that may be elastically compressible. The collapsible container design may reduce or prevent damage or permanent deformation of the collapsible container during lacement of a load on the container. The collapsible container includes a plurality of collapsible panels (106A-D) that articulate in a specific manner during placement of a load, resulting in a controlled and temporary partial collapse of the container from an expanded position to a collapsed position. After removal of the load from the collapsible container, the elastically compressible product may decompress and force the collapsible container to expand from the collapsed position back to the expanded position.

9 Claims, 3 Drawing Sheets

(56) References Cited

U.S. PATENT DOCUMENTS

| | | | | | |
|---|---|---|---|---|---|
| 3,338,407 | A * | 8/1967 | Carlson | B65D 5/42 | 206/219 |
| 4,160,519 | A * | 7/1979 | Gorham | B65D 5/443 | 229/101 |
| 4,817,803 | A * | 4/1989 | Risucci | B65D 5/5495 | 229/101.2 |
| 4,938,413 | A | 7/1990 | Wolfe | | |
| 5,975,411 | A | 11/1999 | Windolph, III | | |
| 6,119,929 | A * | 9/2000 | Rose | B65D 5/0005 | 229/101 |
| 6,394,336 | B1 | 5/2002 | Beneroff et al. | | |
| 6,412,656 | B1 * | 7/2002 | Placik | A47K 10/421 | 221/33 |
| D695,607 | S * | 12/2013 | Karvalis | D9/431 | |
| 8,714,435 | B2 | 5/2014 | Weissbrod | | |
| 9,463,924 | B1 * | 10/2016 | Volin | B65F 1/0006 | |
| 2009/0272790 | A1 * | 11/2009 | Weissbrod | B65D 5/0005 | 229/101 |

OTHER PUBLICATIONS

Packability, "Multi Depth Boxes," http://www.packability.co.uk/multi-depth-boxes, accessed Oct. 19, 2015, p. 1.

* cited by examiner

COLLAPSIBLE CASE

BACKGROUND

Containers such as cardboard boxes are often used to ship items in quantity to a product retailer or end user. Cardboard boxes are typically fabricated from corrugated cardboard to enhance strength of the container to prevent damage to the product within during shipping and storage. A cardboard box may be manufactured with a sufficient strength and rigidity to resist crushing from one or more other containers stacked thereon when, for example, multiple containers are placed on a shipping pallet. High-strength containers, however, are more expensive to manufacture and create more waste than lower-strength containers.

Cardboard boxes have been manufactured to be collapsible, for example, to reduce the storage space required for the empty container before use. These collapsible cardboard boxes may be manufactured with one or more seams that are designed to fold and minimize the space required to store the collapsed empty boxes.

A shipping container such as a cardboard box that may be manufactured at a lower cost using a lower strength cardboard and less material volume, thereby generating less waste and/or recycling, would be a welcome addition to the art.

BRIEF SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In accordance with the present teachings, a collapsible container blank may include a plurality of end panels, a plurality of side panels, and a plurality of collapsible panels, wherein each collapsible panel is interposed between, and connected to, one of the end panels and one of the side panels. The collapsible container blank may also include a plurality of end panel folds, wherein each end panel fold separates one of the end panels from one of the collapsible panels, a plurality of collapsible panel folds, wherein each collapsible panel fold separates one of the collapsible panels from one of the side panels, and a plurality of end panel folds, wherein each end panel fold separates one of the side panels from one of the end panels.

Optionally, the plurality of end panels may be a plurality of top end panels, the plurality of end panel folds may be a plurality of top end panel folds, wherein each top end panel fold separates one of the top end panels from one of the collapsible panels. Further, the plurality of collapsible panel folds may be a plurality of collapsible panel bottom folds, wherein each collapsible panel is interposed between, and connected to, one of the top end panels and one of the side panels. The container blank may further include a plurality of bottom end panels, wherein each side panel is connected to one of the bottom end panels and interposed between one of the collapsible panels and one of the bottom end panels, and a plurality of bottom end panel folds, wherein each bottom end panel fold separates one of the side panels from one of the bottom end panels.

Optionally, the collapsible container blank may further include a plurality of collapsible panel midline folds, wherein each collapsible panel midline fold bisects one of the collapsible panels.

Optionally the collapsible container blank may further include a plurality of top end panel cutouts defined by a perimeter of the collapsible container blank, wherein each top end panel cutout separates one of the top end panels from an adjacent top end panel, and a plurality of bottom end panel cutouts defined by the perimeter of the collapsible container blank, wherein each bottom end panel cutout separates one of the bottom end panels from an adjacent bottom end panel.

Optionally, each top end panel cutout may have a first width and a first height, and each bottom end panel cutout may have a second width and a second height, wherein the first height is greater than the second height. Further optionally, the first height may be at least 1.1 times the second height and the first width may be from 1.25 times to 3.0 times the second width.

Optionally, after an assembly of the collapsible container blank, the plurality of collapsible panels may be configured to articulate upon placing a load on a top surface of the container from an expanded position to a collapsed position and to return to the expanded position when the load is removed from the top surface of the container.

Optionally, each collapsible panel may be configured to fold at one of the collapsible panel midline folds, to hinge at one of the top end panel folds, and to hinge at one of the collapsible panel bottom folds during the articulation from the expanded position to the collapsed position and from the collapsed position to the expanded position.

The present teachings also include a folded and assembled collapsible container including a plurality of top end panels that form a top of the assembled container, a plurality of side panels that form a plurality of sides of the assembled container, a plurality of collapsible panels, wherein each collapsible panel is interposed between, and connected to, one of the top end panels and one of the side panels, a plurality of bottom end panels that form a bottom of the assembled container, wherein each side panel is connected to one of the bottom end panels and interposed between one of the collapsible panels and one of the bottom end panels, a plurality of top end panel folds, wherein each top end panel fold separates one of the top end panels from one of the collapsible panels, a plurality of collapsible panel bottom folds, wherein each collapsible panel bottom fold separates one of the collapsible panels from one of the side panels, and a plurality of bottom end panel folds, wherein each bottom end panel fold separates one of the side panels from one of the bottom end panels.

Optionally, the folded and assembled collapsible container may include a plurality of collapsible panel midline folds, wherein each collapsible panel midline fold bisects one of the collapsible panels.

Optionally, the folded and assembled collapsible container may include a plurality of collapsible panel midline folds, wherein each collapsible panel midline fold does not bisect one of the collapsible panels.

Optionally, the folded and assembled collapsible container may include a plurality of top end panel cutouts, wherein each top end panel cutout separates one of the top end panels from an adjacent top end panel, and a plurality of bottom end panel cutouts, wherein each bottom end panel cutout separates one of the bottom end panels from an adjacent bottom end panel.

Optionally, the collapsible container may have a first height in a fully expanded position and a second height in a fully compressed position, wherein the second height is at least 0.9 times the first height.

Optionally, the plurality of collapsible panels may be configured to articulate upon placing a load on a top surface of the container from an expanded position to a collapsed position and to expand toward the expanded position when the load is removed from the top surface of the container.

Optionally, each collapsible panel may be configured to fold at one of the collapsible panel midlines, to hinge at one of the top end panel folds, and to hinge at one of the collapsible panel bottom folds during the articulation from the expanded position to the collapsed position and from the collapsed position to the expanded position.

The present teachings also include a method for supporting a load using a collapsible container. The method may include placing a load onto an upper surface of the collapsible container. Responsive to the placing of the load on the upper surface of the collapsible container, the method may further include collapsing a plurality of collapsible panels. During the collapsing of the plurality of collapsible panels, each collapsible panel may fold at a collapsible panel midline, each collapsible panel may hinge at a top end panel fold, and each collapsible panel hinges at a collapsible panel bottom fold. The method may further include removing the load from the upper surface of the collapsible container. Responsive to the removing of the load from the upper surface of the collapsible container, the method may further include extending the plurality of collapsible panels. During the extending of the plurality of collapsible panels, each collapsible panel may unfold at the collapsible panel midline, each collapsible panel may hinge at the top end panel fold, and each collapsible panel hinges at the collapsible panel bottom fold.

Optionally, the method may further include transferring a weight of the load from the collapsible container to a compressible product within the collapsible container during the placing of the load onto the upper surface of the collapsible container.

Optionally, the method may further include compressing the compressible product during the placing of the load onto the upper surface of the collapsible container.

Optionally, the removing of the load from the upper surface of the collapsible container results in an expansion of the compressible product.

Optionally, during the expansion of the compressible product, the compressible product may force the collapsible container from a collapsed position toward an expanded position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

It should be noted that some details of the FIGS. have been simplified and are drawn to facilitate understanding of the present teachings rather than to maintain strict structural accuracy, detail, and scale.

DETAILED DESCRIPTION

The following description of the preferred embodiment is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The present teachings may include a container such as a collapsible cardboard box. A product being stored or shipped may be positioned within the container during a controlled collapse of the container. Additionally, the product within the container may itself be collapsible. During use of the collapsible container, a top surface of the container may rest on an upper surface of the product within, or the top surface of the container may be above the upper surface of the product. When a weight such as another container is placed on the top surface of the container, the collapsible container may controllably deformed along folds and/or score lines through the application of the weight, such that the product itself may then received and support at least a portion of the weight. In addition, the product itself may also partially compress during the application of the weight. When the weight is removed, the product within the container may expand or decompress, thereby pushing on the top surface from the inside of the container, thereby re-forming the container. The folds and/or score lines control the collapse and prevent the container from being crushed and permanently deformed by the weight. Because the product within the container, and not the container itself, wholly or largely supports the weight from a top load, the container may be formed from lighter and less costly materials.

Figure 1:
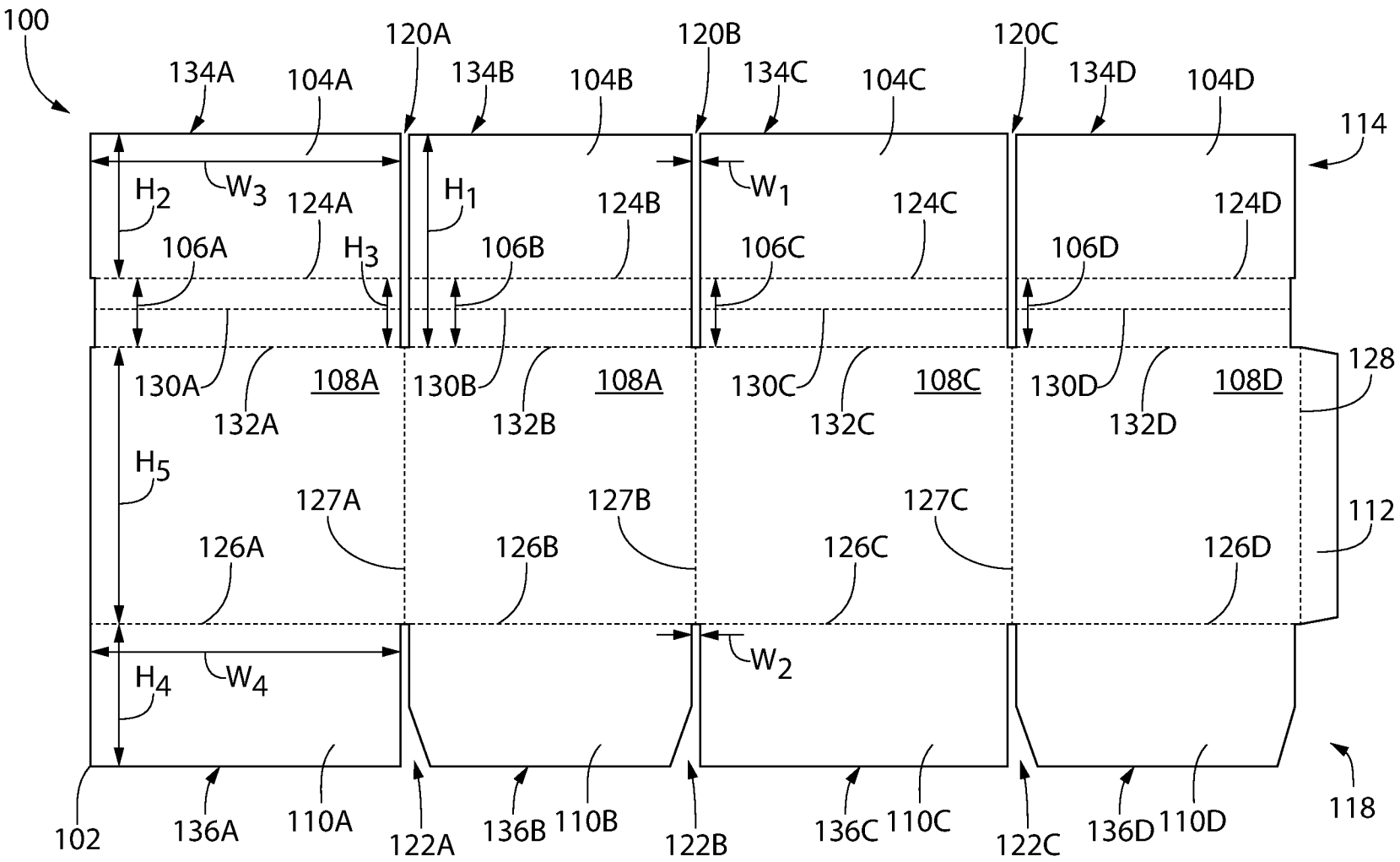
FIG. 1 is a plan view depicting an unfolded and unassembled box blank according to an embodiment of the present teachings.

FIG. 1 is a plan view depicting an unassembled and unfolded container or box blank 100 in accordance with an embodiment of the present teachings. It will be understood that a box blank 100 according to the present teachings may include other features that are not depicted for simplicity, while various depicted features may be removed or modified. The FIG. 1 box blank 100 includes a perimeter 102 and defines a plurality of panels, including a plurality of top end panels (e.g., top end flaps) 104A-104D, a plurality of collapsible panels 106A-106D, a plurality of side panels 108A-108D, a plurality of bottom end panels (e.g., bottom end flaps) 110A-110D, and an assembly panel 112. The plurality of top end panels 104A-104D may be proximate a first end (e.g., top end) 114 of the box blank 100, while the plurality of bottom end panels 110A-110D may be proximate a second end (e.g., a bottom end) 118 of the box blank 100.

Each of the plurality of top end panels 104A-104D may be separated from at least one adjacent top end panel by a top end panel cutout 120A-120C. Each of the plurality of bottom end panels 110A-110D may be separated from at least one adjacent bottom end panel by a bottom end cutout 122A-122C.

The box blank 100 may further include a plurality of pre-creased, pre-formed, or scored folds that assist during assembly of the box blank 100 into a completed box or container. These include a plurality of top end panel folds 124A-124D, a plurality of bottom end panel folds 126A-126D, a plurality of side panel folds 127A-127C and an assembly panel fold 128.

The box blank 100 may further include a plurality of pre-creased, pre-formed, or scored folds that assist to control a collapse of the assembled box during use. These include a plurality of collapsible panel midline folds 130A-130D and a plurality of collapsible panel bottom folds 132A-132D. In addition, the plurality of top end panel folds 124A-124D may also assist to control the collapse of the assembled box during use and may, therefore, be referred to herein as collapsible panel top folds 124A-124D.

As depicted in FIG. 1, each of the top end panel cutouts 120A-120D has a width $W_1$ and a height $H_1$. The height $H_1$ of each top end panel cutout 120A-120C is a distance between an edge 134A-134D of each top end panel 104A-104D and the lower collapsible panel 106A-106D bottom fold 132A-132D. In other words, the height $H_1$ of each top panel cutout 120A-120C is equal to a height $H_2$ of the top end panel 104A-104D between the edge 134A-134D and the top end panel fold 124A-124D, plus a height $H_3$ of the collapsible panel 106A-106D from the top end panel fold 124A-124D to the collapsible panel bottom fold 132A-132D. As depicted, a portion of each top panel cutout 120A-120C is positioned between, and thus physically separates, each collapsible panel 106A-106D from an adjacent collapsible panel 106A-106D.

As depicted in FIG. 1, each of the bottom end panel cutouts 122A-122C has a width $W_2$, that may be the same as width $W_1$ or different, and a height $H_4$ that is different than height $H_1$. The height $H_4$ of each bottom end panel cutout 122A-122D is a distance between an edge 136A-136D of each bottom end panel 110A-110D and the bottom end panel fold 126A-126D. Height $H_4$ also approximates a height of each bottom end panel 110A-110D. Because the height $H_4$ of each bottom end panel 110A-110D will be approximately the same as the height $H_2$ of each top end panel 104A-104D, the height $H_1$ of each top end panel cutout 120A-120C will be greater than the height $H_4$ of each bottom end panel cutout 122A-122C by approximately the height $H_3$ of each collapsible panel 106A-106D from the collapsible panel upper fold 124A-124D to the collapsible panel lower fold 132A-132D. In an embodiment, height $H_1$ may be at least about 1.1 times, or from about 1.1 times to about 1.5 times, or from about 1.2 times to about 1.3 times, height $H_4$. A width $W_2$ of each bottom end panel cutout 122A-122C may be the same or different than the width $W_1$ of each top end panel cutout 120A-120C. Additionally, a total height of the folded and assembled box in an expanded position is determined, at least in part, by a height $H_5$ of the side panels 108A-108D added to the height $H_3$ of the collapsible panels 106A-106D. A total height of the folded and assembled box in a collapsed position is determined, at least in part, by the height $H_5$ of the side panels 108A-108D. In general, height $H_3$ may be, for example, about 0.2 times or less, or about 0.1 times or less, the height $H_5$. such that an overall height of the folded and assembled box in the expanded position is about 1.2 times or less, or about 1.1 times or less, an overall height of the folded and assembled box in the collapsed position. Additionally, height $H_3$ may be, for example, at least about 0.05 times height $H_5$. The heights of the folded and assembled box in the expanded position and the contracted position will vary somewhat with the thickness of the material used to manufacture the blank. A width $W_3$ of each top end panel 104A-104D may be the same or different than a width $W_4$ of each bottom end panel 110A-110D. Additionally, each top end panel 104A-104D may have a width that is the same or different from one or more adjacent top end panels 104A-104D, and each bottom end panel 110A-110D may have a width that is the same or different from one or more adjacent bottom end panels 110A-110D.

Figure 4:
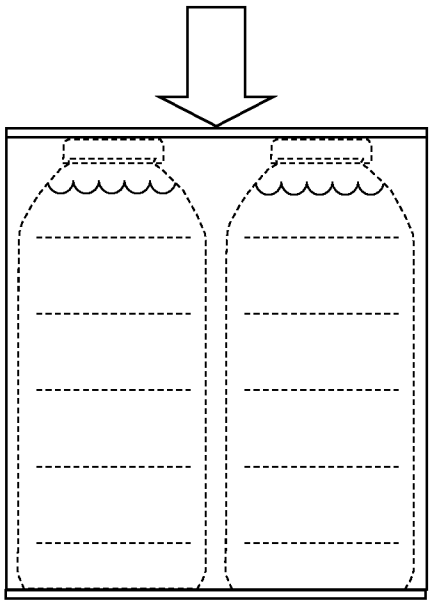
FIG. 4 is a side view of the FIG. 1 box after placement of a load on the top of the box that fully collapses the box.
Figure 3:
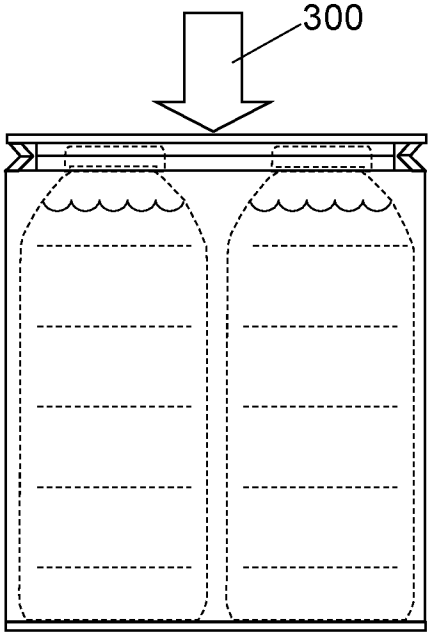
FIG. 3 is a side view of the FIG. 1 box during placement of a load on the top of the box that partially collapses the box.
Figure 2:
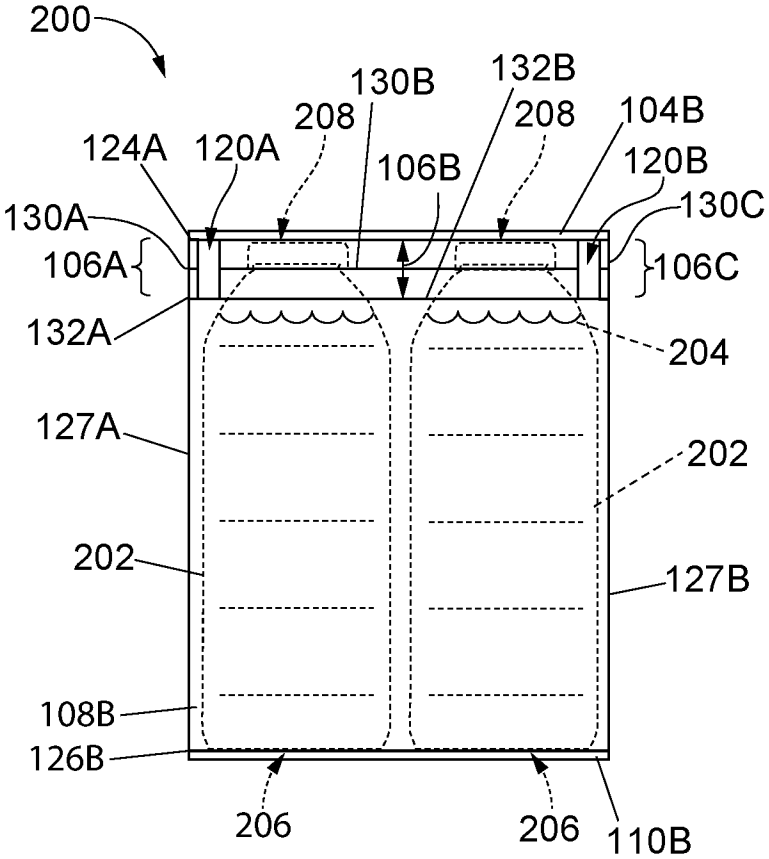
FIG. 2 is a side view depicting a folded and assembled box according to an embodiment of the present teachings, and a product within the box.

FIGS. 2-4 are side views depicting the box blank 100 after folding and assembly to form a completed container or box 200 during use for storing and/or shipping a compressible product 202. The side views of FIGS. 2-4 depict the second side panel 108B, but are generally illustrative of each of the four sides of the box 200. In this embodiment, the compressible product 202 is a bottle storing, for example, a liquid 204, although other compressible products are contemplated. In FIGS. 2-4, the plurality of top end panels 104A-104D form a top of the box 200, for example, a horizontal top of the box 200. Further, the plurality of side panels 108A-108D form a plurality of sides of the box 200, for example, vertical sides of the box 200. Moreover, the plurality of bottom end panels 110A-110D form a bottom of the box 200, for example, a horizontal bottom of the box 200. In the folded and assembled box 200, the assembly panel 112 may be mechanically attached to the to the first side panel 108A using, for example, adhesive, staples, tabs inserted into slots, etc.

FIG. 2 depicts the box 200 prior to compression and while in an expanded, extended, or uncollapsed position. In an embodiment, the box 200 may be specifically designed for a height of the product 202 such that, prior to compression, a bottom surface 206 of the product 202 rests on one or more bottom end panels 110 and a top surface 208 of the product 202 physically contacts (i.e., touches) one or more top end panels 104. In another embodiment, the top surface 208 of the product 202 may be slightly below one or more top end panels 104, for example, about 15 millimeters (mm) or less, or about 10 mm or less, below one or more top end panels 104.

FIG. 3 depicts the box 200 during placement of a load 300 on an upper surface of the box 200, for example, on one or more top end panels 104. The box 200 of FIG. 2 is in a partially collapsed position. The load 300 may be, for example, one or more other boxes 200. During placement of the load 300 on the upper surface of the box 200, the top end panels 104 are forced downward such that, if the top end panels 104 are not already in physical contact with the top surface of the product, they physically contact the top surface 208 of the product 202. Support of the load is thus transferred from the box 200 to the product 202 within the box 200. Further, during placement of the load, the product 202 within the box 200 may elastically compress from the weight of the load 300. In contrast to some conventional containers, which may permanently deform from the weight of the load 300, the box 200 articulates so that the box 200 is not permanently deformed.

During the articulation, each collapsible panel 106A-106D folds inward toward an interior of the box 200, particularly at each collapsible panel midline fold 130A-130D, using the collapsible panel top folds 124A-124D and the collapsible panel bottom folds 132A-132D as hinge points. The collapsible panel midline folds 132A-132D extends inward toward the interior rather than outward to avoid physical contact of the collapsible panels 106A-106D with any adjacent box 200 or other surface such as a wall. Thus, during use of the collapsible container 200, the collapsible container 200 may be used to support the load 300. In an embodiment, the load 300 is placed onto the upper surface of the collapsible container 200. Responsive to placing the load 300, the collapsible panels 106A-106D collapse, during which each collapsible panel 106A-106D folds at the collapsible panel midline 130A-130D, each collapsible panel hinges at the top end panel fold 124A-124D, and each collapsible panel 106A-106D hinges at the collapsible panel bottom fold 132A-132D. Upon removal of the load 300, the plurality of collapsible panels 106A-106D extend, urged, in some embodiments, at least partially by the elastic decompression of the produce 202, during which each collapsible panel 106A-106D unfolds at the collapsible panel midline 130A-130D, each collapsible panel 106A-106D hinges at the top end panel fold 124A-124D, and each collapsible panel 106A-106D hinges at the collapsible panel bottom fold 132A-132D.

During manufacture of the box blank 100, the collapsible panels 106A-106D may be manufactured such that the collapsible panels 106A-106D are biased to fold inward toward the interior of the box 200 rather than outward. For example, the collapsible panel top folds 124A-124D and the collapsible panel bottom folds 132A-132D may be formed by scoring or rolling the interior surface of the box blank 100, while the collapsible panel midline folds 130A-130D may be formed by scoring or rolling an exterior surface of the box blank 100.

The box 200 may only partially collapse to the position depicted in FIG. 3, for example, if an intermediate weight load 300 is placed on top of the box 200 that causes the compressible product 202 to only partially compress and the box 200 to only partially collapse. As depicted in FIG. 4, additional load placed on the top surface of the box 200 may result in a full collapse of the collapsible panels 106A-106D and further compression of the compressible product 202. Further, the load 300 on the box 200 may be a dynamic load that changes over time, for example, during transportation within a vehicle over uneven surfaces. In a full collapse of the box 200, the outer surface of each collapsible panel 106A-106D between the collapsible panel top fold 124A-124D and the collapsible panel midline fold 130A-130D may physically contact the outer surface of each collapsible panel between the collapsible panel midline fold 130A-130D and the collapsible panel bottom fold 132A-132D. By collapsing the box 200, the load 300 is transferred to the product 202, such that the box 200 may be manufactured from less rigid or structurally sound materials, thereby reducing materials and costs.

During removal of the load 300 from the box 200, the elastically compressible product 202 within the box 200 expands or decompresses, and may return to its original shape and height of the FIG. 2 depiction, or may partially return to its original shape and height, for example, when the load 300 is dynamic. This expansion pushes on one or more top end panels 104A-104D, urging and/or forcing the box 200 back into, or approximately into, the FIG. 2 position. The collapsible panels 106A-106D, thereby, reduce or prevent cosmetic or structural damage to the box 200 from the load 300, which may otherwise occur if the box 200 alone supported the load 300 or did not include the collapsible panels 106A-106D.

In contrast to prior collapsible boxes that collapse to minimize a storage space of the empty box when not in use, the collapsible box 200 is designed to collapse while holding or containing a product 202, for example, an elastically compressible product 202. The box 200 collapses as described above, for example, from the expanded position of FIG. 2 to the fully collapsed position of FIG. 4. Upon removal of the load 300, the box 200 and product 202 may return to the fully expanded position of FIG. 2, or to a partially expanded position of FIG. 3.

In an embodiment, the width $W_1$ of each top end panel cutout 120A-120C is sufficiently wide to prevent adjacent collapsible panels 106A-106D from physically contacting or impinging on each other during collapse of the panels. To prevent physical contact between adjacent collapsible panels 106A-106D during the fully collapsed position of FIG. 4, the width $W_1$ may be equal to or greater than the height $H_3$ of one of the collapsible panels 106A-106D. If $W_1$ is less than $H_3$, adjacent collapsible panels 106A-106D may physically contact each other, for example, at the collapsible panel midline folds 130A-130D. Thus the width $W_1$ of each top end panel cutout 120A-120C may be wider than the width $W_2$ of each bottom end panel cutout 122A-122C, as the latter does not require this restriction. In an embodiment, width $W_1$ may be from about 1.0 times and about 3.0 times, or from about 1.25 times to about 3.0 times, or from about 1.5 times to about 2.5 times, width $W_2$.

In the FIG. 2 position, the box may have a first height that extends from the bottom surface to the top surface, and each panel 106A-106D may have a second height that extends from the collapsible panel bottom fold 132A-132D to the collapsible panel top fold 124A-124D. In an embodiment, the second height of each collapsible panel 106A-106D may be about 30% or less, or about 15% or less, of the first height of the box 200. In an embodiment, the second height of each collapsible panel 106A-106D may be about 5% or more of the first height of the box 200.

Additionally, the assembled box 200 may have a first interior volume when in the fully expanded position of FIG. 2, and a second interior volume when in the fully compressed position of FIG. 4. In an embodiment, the second interior volume in the fully compressed position may be about 90% or more, or about 95% or more, of the first interior volume in the fully expanded position.

Moreover, the assembled box 200 may have a first height in the fully expanded position of FIG. 1 that extends from the bottom surface to the top surface, and a second height in the fully compressed position of FIG. 4 that extends from the bottom surface to the top surface. The second height of FIG. 4 may be about 80% (i.e., 0.8 times), or about 90% (i.e., 0.9 times), or about 95% (i.e., 0.95 times) the first height of FIG. 1.

In the embodiment of FIG. 1, the box blank 100 has various characteristics. For example, each of the plurality of side folds 127A-127C is aligned with a longitudinal midpoint of one of the top end panel cutouts 120A-120C. In other words, an axis of each side fold 127A-127C bisects the width $W_1$ of one of the top end panel cutouts 120A-120C. Additionally, a longitudinal axis of each of the plurality of collapsible panel midline folds 130A-130D is aligned with the axes of each of the other collapsible midline folds 130A-130D. Further, a distance between each collapsible panel top fold 124A-124D and a paired (i.e., on the same top end panel 104A-104D) collapsible midline fold 130A-130D is the same as a distance between each collapsible midline fold 130A-130D and a paired collapsible panel bottom fold 132A-132D. In the embodiment of FIG. 1, where each collapsible panel midline fold 103A-130D bisects the height $H_3$, the maximum distance the folded and assembled box is able to collapse within the collapsible panels is $0.5 \times H_3$.

Figure 5:
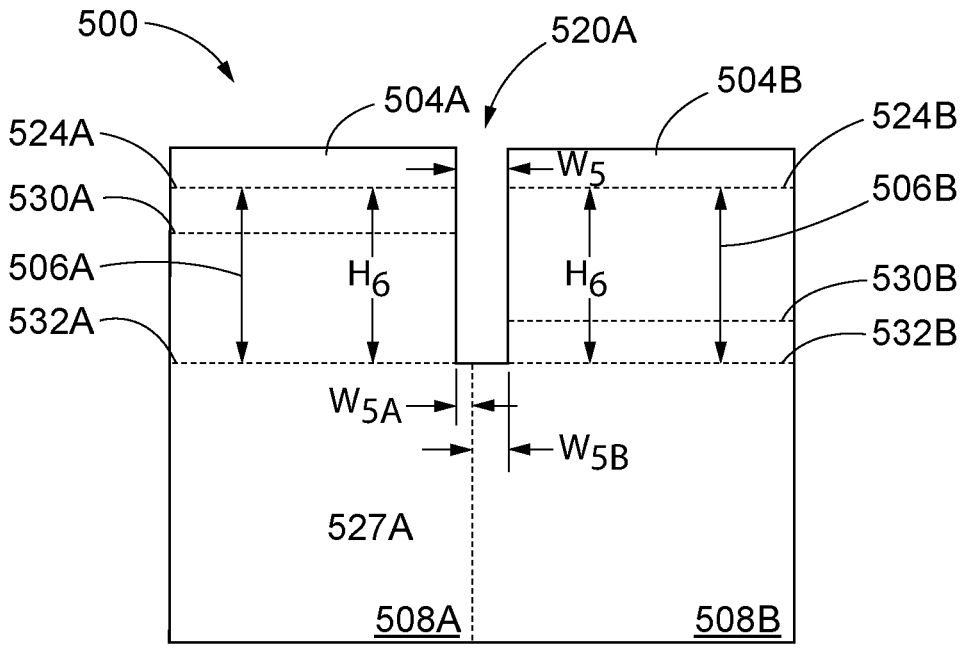
FIG. 5 is a plan view depicting a portion of an unfolded and unassembled box blank according to another embodiment of the present teachings.

FIG. 5 is a depiction of part of a box blank 500 that is designed with to have different characteristics than the embodiment of FIG. 1. It will be appreciated that while FIG. 5 depicts only two top end panels 504A, 504B and two side panels 508A, 508B for simplicity of explanation, the box blank 500 may have bottom end panels 110 and three or more side panels and three or more top end panels, for example, as depicted and described with reference to FIG. 1. It will be further appreciated that, in a box blank for a four sided box, the two side panels 508A, 508B and two top end panels 504A, 504B may be repeated such that the box blank 500 has four top end panels, four side panels, as well as four bottom end panels.

In the FIG. 5 depiction, the side fold 527A is not aligned with a longitudinal midpoint of the top end panel cutout 520A. In other words, the axis of the side fold 127A does not bisect the width $W_5$ of the top end panel cutout 520A. The top end panel cutout 520A has a width $W_5$, where $W_5 = W_{5A} + W_{5B}$, but $W_{5A} \neq W_{5B}$. In some embodiments, this arrangement may prevent adjacent collapsible panels 506A, 506B from physically contacting or impinging on each other during collapse of the panels.

Additionally, in the FIG. 5 embodiment, a longitudinal axis of each of the plurality of collapsible panel midline folds 530A, 530B is not aligned with the axes of adjacent collapsible midline folds 530A, 530B, although the axes of alternating collapsible panels may be aligned. In this arrangement, a distance between each collapsible panel top fold 524A, 524B and a paired (i.e., on the same top end panel 504A, 504B) collapsible midline fold 530A, 530B is not the same as a distance between each collapsible midline fold 530A, 530B and a paired collapsible panel bottom fold 532A, 532B. In the embodiment of FIG. 5, where each collapsible panel midline fold 530A, 530B does not bisect the height $H_6$ of each collapsible panel 506A, 506B, the maximum distance the folded and assembled box is able to collapse within the collapsible panels is less than $0.5 \times H_3$.

FIG. 1 depicts a box blank for a box having four top end panels 104A-104D, four collapsible panels 106A-106D, four side panels 108A-108D, and four bottom end panels 110A-110D, and thus form a box 200 having six sides. It will be appreciated that boxes having other configurations, for example, boxes having three, five, six, seven, etc., side panels and other structures appropriately modified to form a box having collapsible side panels are also contemplated. Additionally, the collapsible container 200 may be manufactured from a material such as cardboard, for example, a corrugated cardboard including a recycled corrugated cardboard, or a synthetic material such as plastic. Moreover, while the depiction of the unfolded and unassembled box blank 100 of FIG. 1, and the resulting folded and assembled box of FIGS. 2-4, depict a regular slotted case (RSC), it will be appreciated that an embodiment of the present teachings may be formed as a wrap-around case or a tray.

Further, while FIGS. 2-4 depict the collapsible panels 106A-106D at an upper end of the collapsible container 200 and attached to top end panels 104A-104D, it will be appreciated that the collapsible panels 106A-106D may be positioned at a lower end of the collapsible container 200 and attached to bottom end panels 110A-110D. In another aspect, if the collapsible container 200 of FIGS. 2-4 is inverted (i.e., vertically rotated or flipped 180°) the top of the collapsible container 200 of FIGS. 2-4 will become the bottom and the bottom will become the top. Thus it will be understood that the terms "top" and "bottom" herein are descriptive but without reference to a physical orientation of either the collapsible container blank 100 or the folded and assembled collapsible container 200.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A collapsible container blank, comprising:

a plurality of top end panels;

a plurality of side panels;

a plurality of collapsible panels, wherein each collapsible panel is interposed between, and connected to, one of the top end panels and one of the side panels;

a plurality of top end panel folds, wherein each top end panel fold separates one of the top end panels from one of the collapsible panels;

a plurality of collapsible panel bottom folds, wherein each collapsible panel bottom fold separates one of the collapsible panels from one of the side panels;

a plurality of bottom end panels, wherein each side panel is connected to one of the bottom end panels and interposed between one of the collapsible panels and one of the bottom end panels;

a plurality of bottom end panel folds, wherein each bottom end panel fold separates one of the side panels from one of the bottom end panels;

a plurality of collapsible panel midline folds, wherein each collapsible panel midline fold bisects one of the collapsible panels;

a plurality of top end panel cutouts defined by a perimeter of the collapsible container blank, wherein each top end panel cutout separates one of the top end panels from an adjacent top end panel; and a plurality of bottom end panel cutouts defined by the perimeter of the collapsible container blank, wherein each bottom end panel cutout separates one of the bottom end panels from an adjacent bottom end panel;

wherein a width of at least one of the collapsible panels is smaller than a width of a corresponding one of the top end panels to which the at least one of the collapsible panels is connected.

2. The collapsible container blank of claim 1, wherein each top end panel cutout has a first width and a first height, and each bottom end panel cutout has a second width and a second height, wherein the first height is greater than the second height.

3. The collapsible container blank of claim 2, wherein the first height is at least 1.1 times the second height and the first width is from 1.25 times to 3.0 times the second width.

4. The collapsible container blank of claim 1 wherein, after an assembly of the collapsible container blank into a container, the plurality of collapsible panels are configured to articulate upon placing a load on a top surface of the container from an expanded position to a collapsed position and to return to the expanded position when the load is removed from the top surface of the container.

5. The collapsible container blank of claim 1, wherein each collapsible panel is configured to fold at one of the collapsible panel midline folds, to hinge at one of the top end panel folds, and to hinge at one of the collapsible panel bottom folds during the articulation from the expanded position to the collapsed position and from the collapsed position to the expanded position.

6. A folded and assembled collapsible container, comprising:

a plurality of top end panels that form a top of the assembled container;

a plurality of side panels that form a plurality of sides of the assembled container;

a plurality of collapsible panels, wherein each collapsible panel is interposed between, and connected to, one of the top end panels and one of the side panels;

a plurality of collapsible panel midline folds, wherein each collapsible panel midline fold bisects one of the collapsible panels into two equal parts;

a plurality of bottom end panels that form a bottom of the assembled container, wherein each side panel is connected to one of the bottom end panels and interposed between one of the collapsible panels and one of the bottom end panels;

a plurality of top end panel folds, wherein each top end panel fold separates one of the top end panels from one of the collapsible panels;

a plurality of collapsible panel bottom folds, wherein each collapsible panel bottom fold separates one of the collapsible panels from one of the side panels;

a plurality of bottom end panel folds, wherein each bottom end panel fold separates one of the side panels from one of the bottom end panels;

a plurality of top end panel cutouts, wherein each top end panel cutout separates one of the top end panels from an adjacent top end panel; and a plurality of bottom end panel cutouts, wherein each bottom end panel cutout separates one of the bottom end panels from an adjacent bottom end panel;

wherein a width of at least one of the collapsible panels is smaller than a width of a corresponding one of the top end panels to which the at least one of the collapsible panels is connected.

7. The folded and assembled collapsible container of claim 6, wherein:

the collapsible container comprises a first height in a fully expanded position; and the collapsible container comprises a second height in a fully compressed position, wherein the second height is at least 0.9 times the first height.

8. The folded and assembled collapsible container of claim 6, wherein the plurality of collapsible panels are configured to articulate upon placing a load on a top surface of the container from an expanded position to a collapsed position and to expand toward the expanded position when the load is removed from the top surface of the container.

9. The folded and assembled collapsible container of claim 8, wherein each collapsible panel is configured to fold at one of the collapsible panel midlines, to hinge at one of the top end panel folds, and to hinge at one of the collapsible panel bottom folds during the articulation from the expanded position to the collapsed position and from the collapsed position to the expanded position.

* * * * *